US005592830A

United States Patent [19]

Baba et al.

[11] Patent Number: 5,592,830

[45] Date of Patent: Jan. 14, 1997

[54] REFRIGERANT CONDENSER WITH INTEGRAL RECEIVER

[75] Inventors: Norimasa Baba, Nagoya; Michiyasu Yamamoto, Chiryu, both of Japan

[73] Assignee: NipponDenso Co., Ltd., Kariya, Japan

[21] Appl. No.: 505,637

[22] Filed: Jul. 21, 1995

[30] Foreign Application Priority Data

Jul. 22, 1994 [JP] Japan ..... 6-170870

[51] Int. Cl.[6] ..... F25B 39/04

[52] U.S. Cl. ..... 62/509; 72/370; 165/132

[58] Field of Search ..... 165/132; 62/509; 29/425, 428; 72/370

[56] References Cited

U.S. PATENT DOCUMENTS 2,650,636 9/1953 Jennings, Jr. ..... 72/152

5,228,315 7/1993 Nagasaka et al. ..... 62/509

5,419,141 5/1995 Burk ..... 62/509

FOREIGN PATENT DOCUMENTS 4320771 11/1992 Japan .

*Primary Examiner*—William E. Wayner

*Attorney, Agent, or Firm*—Cushman, Darby & Cushman

[57] ABSTRACT

A receiver is joined integrally to a header or a condenser at the flat portions formed at joined surfaces thereof. A flat portion is formed by pressing on a portion (central portion) of a tank plate of a header which has a longer vertical length than a receiver. A rib is formed to extend in the lengthwise direction of the flat portion, and excess material at the time of pressing is absorbed by forming the rib, so that wrinkling does not occur.

11 Claims, 4 Drawing Sheets

REFRIGERANT CONDENSER WITH INTEGRAL RECEIVER

CROSS REFERENCE OF RELATED APPLICATIONS

This application is based upon and claims priority from Japanese Patent Application No. Hei 6-170870 filed Jul. 2, 1994, the contents of which document are incorporated herein by reference.

BACKGROUND OF THE INVENTION

1. Field of the Invention

The present invention relates to a refrigerant condenser with an integral receiver employed in what is generally termed a refrigeration cycle, and is favorable for employment in an automotive air-conditioning apparatus where for example an amount of refrigerant recirculation fluctuates greatly.

2. Description of the Related Art

Conventionally, a receiver and a condenser have been disposed individually and independently in a refrigeration cycle of an automotive air-conditioning apparatus. For this reason, cost reduction due to a reduction in the number of parts has been difficult, and because the receiver and the condenser mutually occupy installation space, there has existed the problem of being unable to accommodate demand for space savings. In this regard, providing a vapor-liquid separation chamber to play the role of the receiver on an outlet-side header portion of a condenser is proposed in Japanese Patent Application Laid-Open No. 4-320771.

These prior arts are explained in FIGS. 8 and 9, wherein a tubular body 33 of a receiver 9 is integrally brazed to a tank plate 32 of a header 16 of a refrigerant outlet side of a condenser 3. In performing this brazing, to ensure brazing strength of the tank plate 32 and the tubular body 33, the brazing location of the two members is formed mutually at flat portions 32*a* and 33*a*.

However, it is acceptable for the height of the receiver 9 to be normally low in comparison with the height of the condenser 3, and so the flat area 33*a* comes to be formed over the entire surface in the lengthwise direction of the tubular body 33 on the receiver 9, whereas the flat portion 32*a* is formed on a portion in the lengthwise direction of the tank plate 32 on the receiver 3.

The foregoing tank plate 32 and tubular body 33 are formed by pressing a metal such as aluminum, but at that time, the tubular body 33 of the receiver 9 forms the flat portion 33*a* over the entire surface in the lengthwise direction thereof, and so the circumferential cross-sectional length is identical for any section, and no particular problem occurs in pressing.

However, it has been determined through prototyping and investigation by the inventors that the problem described hereinafter occurs at the header 16 of the condenser 3.

Namely, because the flat portion 32*a* must be formed on a portion (central portion only) in the lengthwise direction Of the tank plate 32 at the header 16 of the condenser 3, circumferential cross-sectional length becomes different at an existing portion and nonexistent portion of the flat portion 32*a*. That is to say, the circumferential cross-sectional length becomes small at an existing portion of the flat portion 32*a*, and the circumferential cross-sectional length becomes large at a nonexistent portion of the flat portion 32*a*.

Because two portions in which the circumferential cross-sectional length varies in size coexist in the length-wise direction of the tank plate 32 of the condenser 3 in this way, it has been determined that aluminum material does not flow smoothly at the flat portion 32*a* during press working, a state of excess material is obtained, this causes "wrinkling" 32*a'* indicated in FIG. 9 to occur on the flat portion 32*a* of the tank plate 32, and it becomes difficult to maintain the flatness of the flat portion 32*a*.

Refrigerant passage holes (not illustrated in FIGS. 8 and 9) are provided in the flat portions 32*a* and 33*a* of the foregoing tank plate 32 and tubular body 33, and so if the flatness of this passage hole perimeter is degraded, brazing performance of this portion becomes poor, and a problem of proneness to refrigerant leakage is caused.

SUMMARY OF THE INVENTION

It is an object of the present invention to provide a refrigerant condenser with an integral receiver which can effectively prevent occurrence of wrinkling on a flat portion constituting a junction surface of a header of a condenser and a receiver by a simple structure.

To achieve the foregoing object, the present invention utilizes technical measures which will be described hereinafter.

A refrigerant condenser with an integral receiver, includes a core having a condenser portion to condense refrigerant flowing horizontally;

- a header extending vertically at one end portion of said core, and connected to a downstream-side portion of the condenser portion, the header having a communication chamber therein communicating with one end of the condenser portion;
- a receiver disposed to one side of the communicating chamber and having a vapor-liquid separation chamber for separating vapor-liquid of refrigerant;
- a refrigerant introducing means for introducing refrigerant in the communicating chamber into the vapor-liquid separation chamber; and
- a refrigerant discharging means for discharging refrigerant located below the introducing means and in the vapor-liquid separation chamber to an outside of the separation chamber; wherein:
  - the header and the receiver are formed from first and second tubular bodies which extend vertically;
  - at least one of the first and second tubular bodies has a first flat portion and a curved portion on an outer-wall surface thereof, and the other has at least a second flat portion to join with the first flat portion;
  - the first flat portion has a rib depressed toward an inner side thereof.

In the present invention, a header and receiver of a condenser are both composed of tubular bodies. A flat portion is formed on a portion of the junction surface of the tubular bodies. A rib (excess-material absorbing portion) is formed on this flat portion, and so excess material arising due to the coexistence of two portions of differing cross-sectional length can favorably be absorbed when pressing the flat portion, occurrence of wrinkling on the flat portion can be prevented, and as a result thereof, there great effectiveness in being able to reliably prevent problems such as joining defects and even refrigerant leakage based on the occurrence of the foregoing wrinkling.

DETAILED DESCRIPTION OF THE PREFERRED EMBODIMENT

Figure 1:
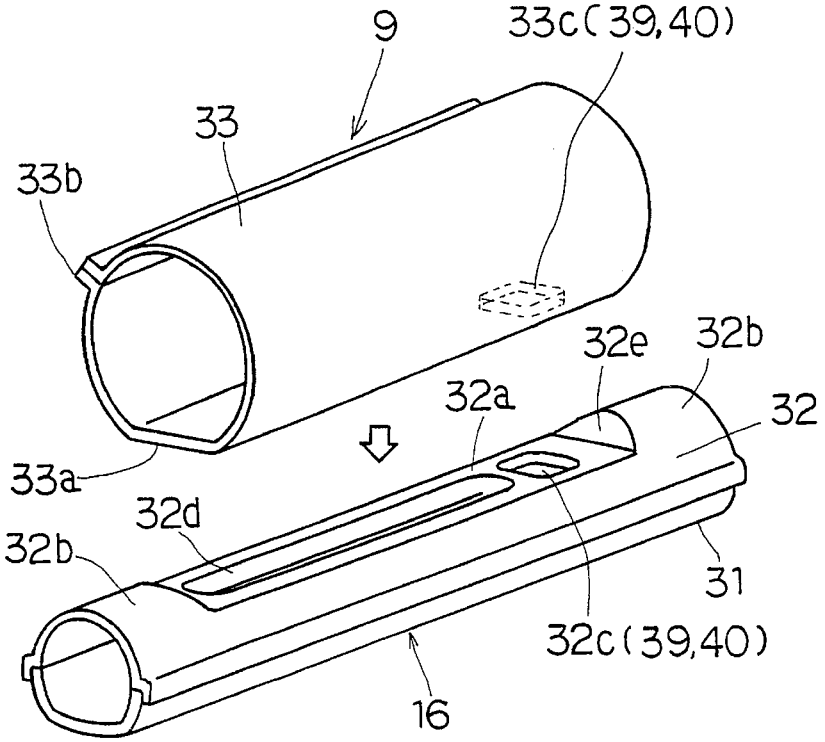
FIG. 1 is an exploded perspective of a second header and collector portion indicating a first embodiment according to the present invention.

A preferred embodiment according to the present invention will be described hereinafter with reference to the drawings. FIGS. 1 to 6 indicate an embodiment of a refrigerant condenser with an integral receiver according to the present invention applied in an automotive air-conditioning apparatus. FIG. 3 shows a schematic of an overall structure of a refrigeration cycle of an automotive air-conditioning apparatus and the refrigerant condenser according to the present invention. This automotive air-conditioning apparatus refrigeration cycle 1 sequentially connects a refrigerant compressor 2, integral-receiver refrigerant condenser 3, sight glass 4, expansion valve 5, and refrigerant evaporator 6 by refrigerant piping 7 composed of metal pipes or rubber pipes.

The refrigerant compressor 2 is interconnected via a belt V and electromagnetic clutch (power-interruption means) C with an engine (not illustrated) disposed within an engine compartment of an automobile. When rotating power of the engine E is transmitted to this refrigerant condenser 2, vapor-phase (gas) refrigerant which has been taken in from the refrigerant evaporator 6 is compressed, and high-temperature, high-pressure vapor-phase refrigerant is discharged to the integral-receiver refrigerant compressor 3.

The integral-receiver refrigerant condenser 3 integrally disposes a condenser portion 8, a receiver 9, and a supercooling portion 10. The condenser portion 8 is connected to a discharge side of the refrigerant compressor 2, and functions as a condensing means which causes supercooled vapor-phase refrigerant which has been taken in from the refrigerant compressor 2 to exchange heat with outside air sent by a cooling fan (not illustrated) or the like and causes condensation and liquefaction of the refrigerant.

The receiver 9 performs vapor-liquid separation of refrigerant taken in from the condenser portion 8 into vapor-phase refrigerant and liquid-phase refrigerant, and functions as a vapor-liquid separation means which supplies only liquid-phase refrigerant to the supercooling portion 10. The supercooling portion 10 is disposed adjacently below the condenser portion 8 disposed on an upper side, and functions as a supercooling means which causes liquid-phase refrigerant which has been taken in from the receiver 9 to exchange heat with outside air sent by a cooling fan or the like and supercools the liquid-phase refrigerant.

The sight glass 4 is connected to a downstream side of the supercooling portion 10 of the integral-receiver refrigerant condenser 3, and functions as a refrigerant-inspection means to monitor the vapor-liquid state of refrigerant circulating within the refrigeration cycle 1 and inspect for an excessive or insufficient amount of refrigerant enclosed within the cycle. This sight glass 4 may be independently suspended in a location within the engine compartment of the automobile which facilitates visual confirmation by an inspector, for example partway along the refrigerant piping 7 adjacent to the integral-receiver refrigerant condenser 3. In general, refrigerant is insufficient when air bubbles are seen from a peephole of the sight glass 4, and the amount of refrigerant is correct when air bubbles are not seen.

The expansion valve 5 is connected to a refrigerant-inlet side of the refrigerant evaporator 6 and functions as a pressure-reducing means to insulate and expand high-temperature, high-pressure liquid-phase refrigerant flowing in from the sight glass 4 and create low-temperature, low-pressure vapor-liquid two-phase refrigerant in a mist state. According to the present embodiment, a temperature-operated type expansion valve which automatically regulates the degree of valve opening so that the degree of refrigerant superheating of a refrigerant outlet of the refrigerant evaporator 6 is maid at a predetermined value is employed.

The refrigerant evaporator 6 is connected between an intake side of the refrigerant compressor 2 and a downstream side of the expansion valve 5, and functions as a cooling means which causes refrigerant in a vapor-liquid two-phase state which flows in from the expansion valve 5 to exchange heat with outside air or passenger-compartment air blown in by a fan for air-conditioning use (not illustrated), cause the refrigerant to evaporate, and cool blown air by the latent evaporation heat thereof.

A specific structure of the integral-receiver refrigerant condenser 3 according to the present embodiment will be described hereinafter in greater detail. This integral-receiver refrigerant condenser 3 is of a size with for example a height of 300 to 400 mm and a width of approximately 300 to 600 mm, and is mounted via a mounting bracket (not illustrated) on a vehicle body in a location within the engine compartment of the automobile which easily catches traveling wind, so as to normally be positioned forward of a radiator for engine cooling-water cooling use. Accordingly, the integral-receiver refrigerant condenser 3 is formed of a core 14 which performs heat exchange, a first header 15 disposed on a horizontal end side of this core 14, a second header 16 disposed on another horizontal end side of the core 14, the receiver 9, and the like. These structural components are all formed of aluminum, and are fabricated by integral brazing in a furnace.

The core 14 is composed of the above-described condenser portion 8 and supercooling portion 10, side plates 17 and 18 to fix a mounting bracket to mount the integral-receiver refrigerant condenser 3 on the body of the automobile are joined by a joining method of brazing or the like on the upper-end portion and lower-end portion of these. The upper-side condenser portion 8 is composed of a plurality of tubes for condensing 19 and corrugated fins 20 extending horizontally, and these are joined by a joining method of brazing or the like. The lower-side supercooling portion 10 is composed of a plurality of tubes for supercooling 21 and corrugated fins 22 extending horizontally, and these are joined by a joining method of brazing or the like.

For the side plates 17 and 18, the predetermined configuration which is illustrated is obtained by pressing a metal plate of aluminum or aluminum alloy which has been clad with brazing material, so that the two horizontal end portions are inserted respectively into the first header 15 and second header 16.

The plurality of tubes for condensing 19 and tubes for supercooling 21 are refrigerant-passage forming devices, and are formed by extrusion of aluminum or aluminum-alloy material having excellent corrosion resistance and thermal conductivity into a flattened elliptical cross-sectional configuration and moreover a configuration having a plurality of refrigerant passages disposed interiorly in parallel. Additionally, the corrugated fins 20 and 22 are devices for promoting heat radiation to improve the heat-radiating efficiency of the refrigerant, and are formed by pressing a metal plate of aluminum, aluminum alloy, or the like clad with brazing material on both the front and back surfaces of the plate into a corrugated configuration.

Accordingly, refrigerant from the first header 15 of the refrigerant-inlet side flows horizontally within the plurality of tubes for condensing 19 and flows into the second header 16, and meanwhile refrigerant flowing within the plurality of tubes for supercooling 21 conversely flows horizontally from the second header 16 and flows into the first header 15. Additionally, according to this embodiment, the number of tubes for condensing 19 is made to be greater than the number of tubes for supercooling 21; according to actual experimentation, the number of tubes for supercooling 21 is preferably about 15% to 20% of the entirety of the core 14.

The first header 15 is composed of a header plate 23 of a substantially U-shaped cross-sectional configuration and a tank plate 24 of a crescent-shaped cross-sectional configuration, and presents a substantially tubular-body configuration which extends vertically. The two plates 23 and 24 of this first header 15 respectively obtain the above-described predetermined configuration by pressed metal plates of aluminum or aluminum alloy having excellent corrosion resistance and thermal conductivity and clad on both sides with brazing material.

Furthermore, the upper-side portion of the first header 15 is connected to an upstream end of the plurality of tubes for condensing 19 forming the condenser portion 8, and the lower-side portion is connected to a downstream end of the plurality of tubes for supercooling 21 forming the supercooling portion 10. Accordingly, a cap 25 is fitted into an opening of the vertical-direction (i.e., the axial direction of the tubular configuration) vertical end portion of the first header 15.

The cap 25 is formed into a substantially tubular configuration by pressing a metal plate of aluminum or aluminum alloy clad with brazing material, and is joined to the vertical end portion of the first header 15 by a joining method of brazing or the like.

A multiplicity of elliptical escape holes not illustrated are formed in the header plate 23 by pressing, and the upstream end of the plurality of tubes for condensing 19 as well as the downstream end of the plurality of tubes for supercooling 21 are joined to this multiplicity of escape holes in an inserted state by a joining method of brazing or the like. Additionally, insertion tabs on left-hand edges of the side plates 17 and 18 are joined to hole portions not illustrated of the header plate 23 by a joining method of brazing or the like.

The tank plate 24 is formed with a hole portion to secure a separator 26 vertically partitioning the interior, a hole portion to secure inlet piping 27, and a hole portion to secure outlet piping 28. The foregoing separator 26 is formed in a substantially disc configuration, and separates the interior of the first header 15 into an inlet-side communicating chamber 29 which is communicated only with the upstream end of the condenser portion 8 and an outlet-side communicating chamber 30 which is communicated only with the downstream end of the supercooling portion 10.

The inlet piping 27 is piping of tubular configuration to cause high-temperature, high-pressure superheated vapor-phase refrigerant discharged from the refrigerant compressor 2 to flow into the inlet-side communicating chamber 29, and is joined to the tank plate 24 by a joining method of brazing or the like. The outlet piping 28 is piping of tubular configuration which sends liquid-phase refrigerant within the outlet-side communicating chamber 30 to the sight glass 4 side, and is joined to the tank plate 24 by a joining method of brazing or the like.

Figure 2:
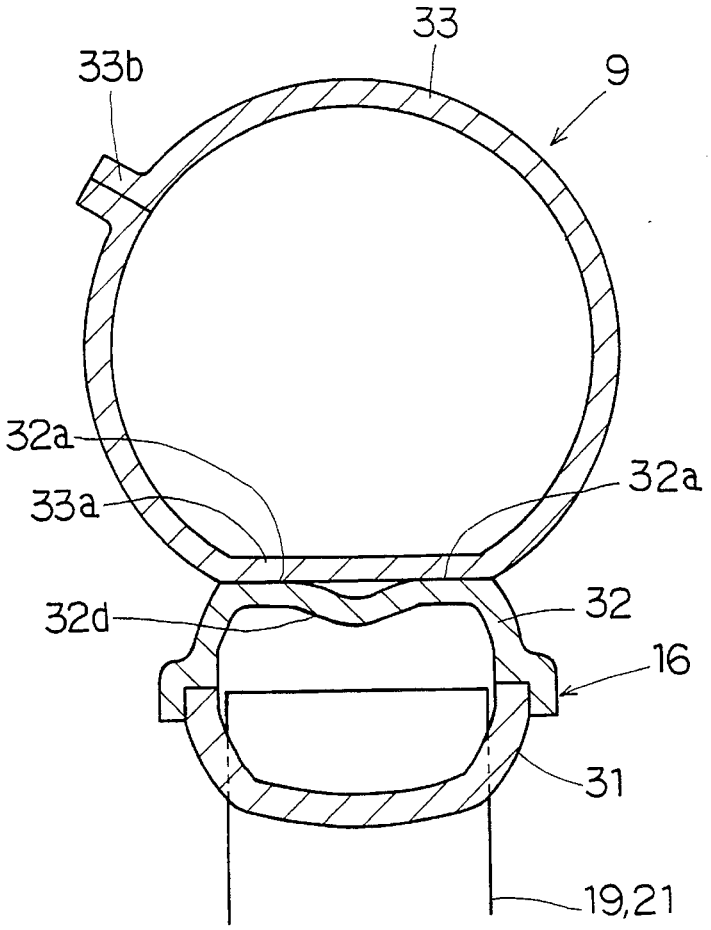
FIG. 2 is a sectional view of a portion of FIG. 1 after integral brazing.
Figure 3:
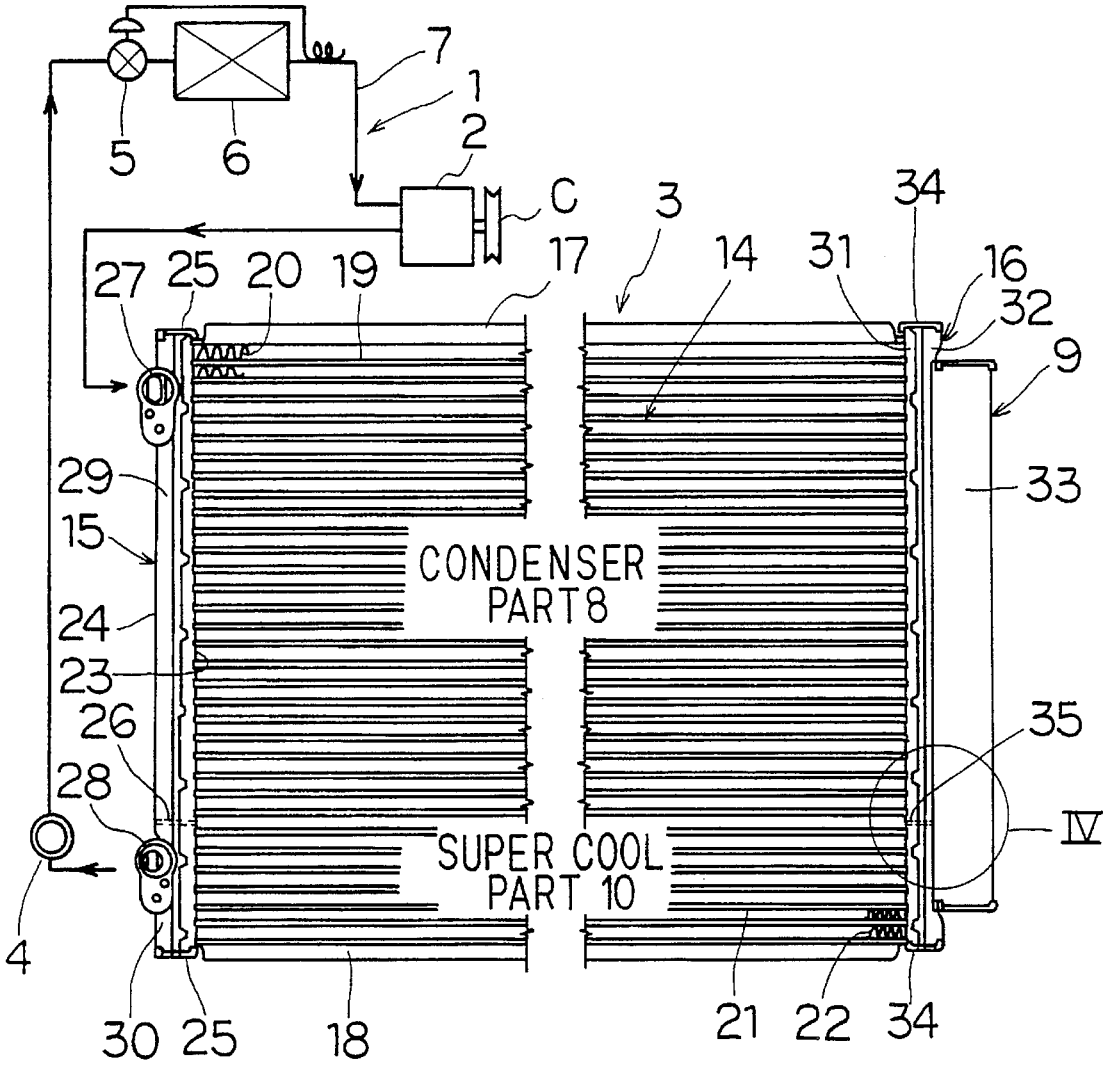
FIG. 3 is a refrigeration cycle diagram of an automotive air-conditioning apparatus provided with a condenser applying the present invention.

As shown in the enlarged views of FIGS. 1 and 2, the second header 16 is composed of a header plate 31 of a substantially U-shaped cross-sectional configuration, and a tank plate 32 having a flat portion **32*a* in a central portion in a lengthwise direction and having a arc portion 32*b*** of a substantially arc-shaped cross-sectional configuration.

Accordingly, the receiver 9 has a shorter vertical length than the second header 16 (see FIGS. 1 and 3), and is formed of a tubular body 33 having a substantially tubular configuration with a flat portion **33*a* corresponding to the foregoing flat portion 32*a*** formed over the entire vertical length.

This tubular body 33 and the two plates 31 and 32 of the second header 16 are respectively pressed from plates of aluminum or aluminum alloy with excellent corrosion resistance and thermal conductivity and clad on both sides with brazing material. The tubular body 33 is formed by brazing a collar portion **33*b*** on both ends after forming a single plate into a substantially tubular configuration.

Additionally, the upper-side portion of the first header 16 is connected to a downstream end of the plurality of tubes for condensing 19 which structure the condenser portion 8, and the lower-side portion is connected to the upstream end of the plurality of tubes for supercooling 21 forming the supercooling portion 10. Accordingly, a cap 34 is fitted into an opening of the vertical-direction (i.e., the axial direction of the tubular configuration) vertical end portion of a tubular spaced formed by the header plate 31 and tank plate 32 of the second header 16.

This cap 34 is joined to the vertical end portion of the foregoing tubular space by a joining method of brazing or the like, and, similarly to the above-described cap 25, is formed into a substantially tubular configuration by pressing an aluminum plate clad on both sides with brazing material.

A multiplicity of elliptical escape holes (not illustrated) are formed in a header plate 36 by pressing a metal plate composed of aluminum clad on both sides with brazing material, and the downstream end of the plurality of tubes for condensing 19 as well as the upstream end of the plurality of tubes for supercooling 21 are joined to this multiplicity of escape holes in an inserted state by a joining method of brazing or the like. Additionally, insertion tabs on right-hand edges of the side plates 17 and 18 are joined to hole portions not illustrated of the header plate 36 by a joining method of brazing or the like.

The reason for providing the flat portions **33*a* and 32*a* on mutually opposing surfaces of the tubular body 33 and tank plate 32 is to suppress protrusion in the lateral (horizontal) direction of the receiver 9 and second header 16 portions, and to ensure a brazed surface area between the tubular body 33 and tank plate 32**.

Meanwhile, the interior of the tubular space formed by the header plate 31 and tank plate 32 is vertically separated into an upstream-side communicating chamber 36 (see FIG. 4) and a downstream-side communicating chamber 37 (see FIG. 4) by a separator 35. The tubular body 33 of the receiver 9 is positioned to a side (outer side) of these two communicating chambers 36 and 37, and a vapor-liquid separator 38 is formed within this tubular body 33.

The foregoing upstream-side communicating chamber 36 is communicated only with the downstream end of the condenser portion 8, the foregoing downstream-side communicating chamber 37 is communicated only with the upstream end of the supercooling portion 10, and the upstream-side communicating chamber 36 is communicated below a refrigerant liquid level 9*a* (this liquid level 9*a* being a liquid level when the amount of refrigerant enclosed within the cycle is a normally appropriate amount) of a vapor-liquid separation chamber 38 at a substantially rectangular refrigerant inlet port 39 provided near a bottom portion thereof (i.e., a lowermost portion of the condenser portion 8), or in other words, with a liquid-refrigerant collection area within the chamber 38. Furthermore, the vapor-liquid separation chamber 38 is communicated with the downstream-side communicating chamber 37 at a substantially rectangular refrigerant outlet port 40 provided near a bottom portion thereof (in other words, a location lower than the refrigerant inlet port 39).

Figure 4:
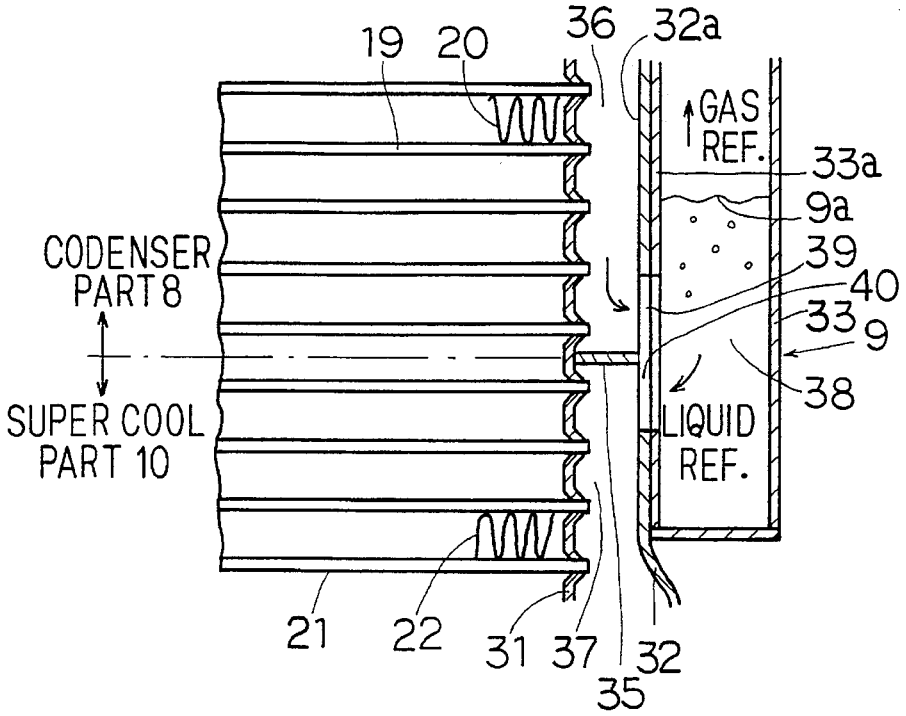
FIG. 4 is a partial enlarged view of portion circled with IV in FIG. 3.

The substantially rectangular refrigerant inlet port 39 and refrigerant outlet port 40 indicated in FIG. 4 are formed by disposing the separator 35 intermediately between one passage hole 32*c* and 33*c* provided on the tank plate 32 and tubular body 33 and dividing this hole into two, but it is of course also acceptable to form the refrigerant inlet port 39 and refrigerant outlet port 40 by respectively independent passage holes so as to dispose the separator 35 at a position intermediate between these two holes.

As an incidental comment, the tank plate 32 is of a configuration having a flat portion 32*a* in a central portion in a lengthwise direction and an arc portion 32*b* on both end portions, as was stated earlier. Two portions for which circumferential cross-sectional length differs in size come to coexist in the lengthwise direction of the tank plate 32, and this becomes a cause of wrinkling occurring in the flat portion 32*a*, but according to the present embodiment the flat portion 32*a* is formed with a rib 32*d* extending in a lengthwise direction thereof and indented concavely to the tubular-space inner side, as shown in FIGS. 1 and 2, so as to prevent occurrence of the above-mentioned wrinkling.

The mode of operation of this prevention of the occurrence of wrinkling will be described in detail hereinafter. Pressing formation of the tank plate 32 is performed in the sequence indicated in FIG. 5. Firstly, as shown in (a) of FIG. 5, an arc configuration is formed from a plate of aluminum.

Figure 5:
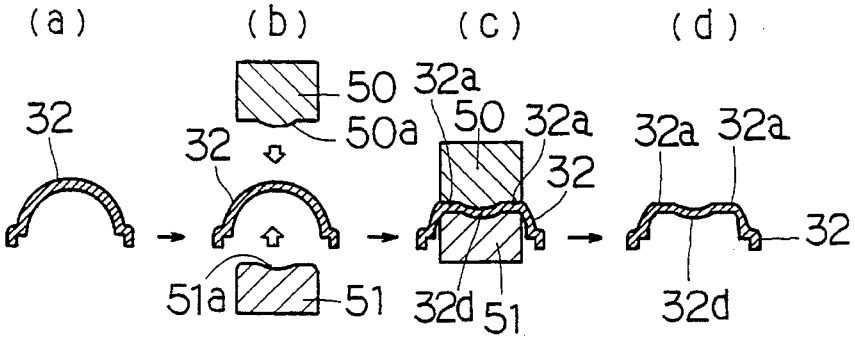
FIGS. 5A to 5D are sequential explanatory views of pressing working of a tank plate of a second header according to the present invention.

Next, as shown in (b) of FIG. 5, upper and lower pressing dies 50 and 51 having a convexity 50*a* and a concavity 51*a* in central portions are employed, these pressing dies 50 and 51 are caused to be transferred in the direction of the arrows in the drawing, the flat portion 32*a* and rib 32*d* are formed simultaneously as shown in (c) of FIG. 5, and the predetermined configuration indicated in (d) of FIG. 5 is obtained.

In the above-described pressing process, it is important to maintain a degree of flatness in the perimeter of the passage hole 32*c* (areas A and B of FIG. 6) to prevent refrigerant leakage. Because the passage hole 32*c* is normally disposed near the end portion of the receiver 9, it comes to be positioned near an end portion (lower-end portion) of the flat portion 32*a*.

Figure 6:
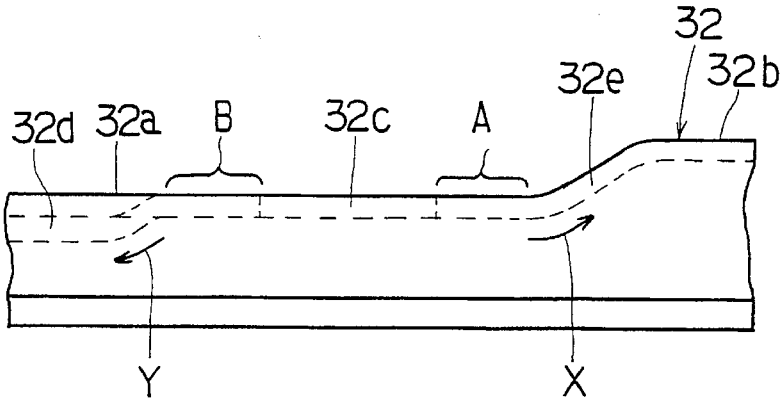
FIG. 6 is an explanatory drawing to describe behavior of materials at a time of pressing formation of a tank plate of a second header according to the present invention.

For this reason, behavior of aluminum material in the proximity of the passage hole 32*c* during pressing is performed as shown in FIG. 6, the aluminum material of area A at one side of the passage hole 32*c* is pulled to the incline (half-pressed surface) 32*e* side as indicated by arrow X, the aluminum material of area B at the other side is pulled to the rib 32*d* side as indicated by arrow Y, and excess material of the flat portion in the passage hole 32*c* perimeter is favorably eliminated.

In this way, the occurrence of wrinkling in the passage hole 32*c* perimeter can be prevented, and the degree of flatness can be ensured, and so a favorable degree of flatness can be ensured.

Furthermore, if the width of the flat portion in the rib 32*d* perimeter of can be assured to be about 2 to 3 mm, no problem in brazing performance exists, and so the size of the rib 32*d* may be established within a range in which a flat portion of the foregoing width can be assured in the perimeter thereof.

Figure 7A:
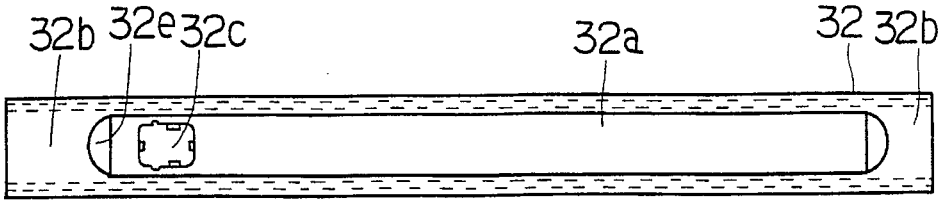
FIGS. 7A and 7B are a plan view and a front view of a comparative example to describe effects according to the present invention.
Figure 7B:
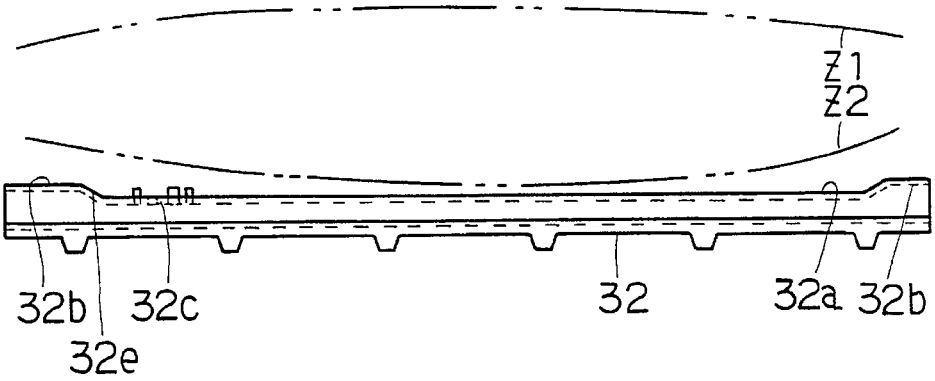
Figure 8:
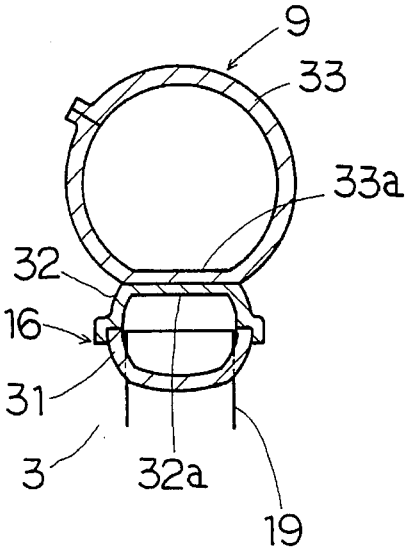
[PRIOR ART] FIG. 8
FIG. 8 is a sectional views of a second header and condenser portion according to the prior art.
Figure 9:
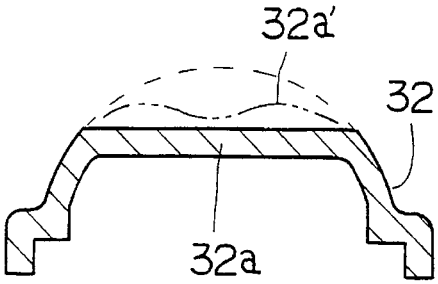
FIG. 9 is a sectional view of a tank plate.

Additionally, in a case where the rib 32*d* is not formed in the flat portion 32*a*, a phenomenon wherein the tank plate 32 warps in the lengthwise direction indicated by Z1 or Z2 in FIG. 7B due to excess material in the flat portion 32*a* during pressing, but this warpage of the tank plate 32 can also be prevented by formation of the rib 32*d*.

A mode of operation of the present embodiment according to the above-described structure will be described next.

When operation of the automotive air-conditioning apparatus is started, the electromagnetic clutch C is electrified and the refrigerant compressor 2 is driven to rotate by the engine via the electromagnetic clutch C.

For this reason, high-temperature, high-pressure vapor-phase refrigerant compressed within the refrigerant compressor 2 and discharged flows through the inlet piping 27 and into the inlet-side communicating chamber 29 of the first header 15, and is distributed from here to the plurality of tubes for condensing 19 forming the condenser portion 8.

Accordingly, the vapor-phase refrigerant distributed to the plurality of tubes for condensing 19 exchanges heat with outside air via the corrugated fins 20 and is condensed and liquefied as it passes through this tubes for condensing 19, and virtually all becomes liquid-phase refrigerant, leaving a portion of vapor-phase refrigerant. This refrigerant flows from the plurality of tubes for condensing 19 and into the upstream-side communicating chamber 36 of the second header 16, and is collected once within this upstream-side communicating chamber 36. At this time, vapor-phase refrigerant in a minute air-bubble form which exits the plurality of tubes for condensing 19 is collected within the upstream-side communicating chamber 36, becomes vapor-phase refrigerant in an air-bubble form with a large diameter, and comes to be strongly subjected to the influence of buoyancy.

Subsequently, refrigerant which has flowed into the upstream-side communicating chamber 36 passes through the refrigerant inlet port 39 and flows into liquid-phase refrigerant below the refrigerant liquid level 9*a* within the receiver 9 (vapor-liquid separation chamber 38). In the receiver 9 (vapor-liquid separation chamber 38), the speed of the refrigerant is reduced by obtaining a cross-sectional surface area thereof of a certain size, and moreover buoyancy of the vapor-phase refrigerant of air-bubble form is utilized to perform vapor-liquid separation of the refrigerant.

Additionally, because the refrigerant is made to pass through the inlet port 39 from the chamber 36 and flow into lower liquid-phase refrigerant within the vapor-liquid separation chamber 38, foaming due to the inlet of refrigerant at the liquid level 9*a* within the chamber 38 does not occur, vapor-liquid separation of the refrigerant becomes even more favorable, and a stabilized vapor-liquid surface level within the receiver 9 is produced.

Furthermore, because the second separator 35 causes the refrigerant which has flowed into the second header 16 from the plurality of tubes for condensing 19 to make a U-turn and flow out to the plurality of tubes for supercooling 21, centrifugal force based on the U-turn flow (reverse vector) is received when refrigerant containing air bubbles passes from the refrigerant inlet port 39 to the receiver 9 and to the refrigerant outlet port 40, and liquid-phase refrigerant with a high specific gravity is transferred to an outside portion of the tubular body 33 and vapor-phase refrigerant with a low specific gravity collects near the second separator 35, even if the refrigerant inlet port 39 and refrigerant outlet port 40 are comparatively proximate.

In this way, vapor and liquid are separated by centrifugal force, more vapor-phase refrigerant in air-bubble form collects, the diameter of vapor-phase refrigerant in air-bubble form becomes larger, the influence of buoyancy is received more strongly, and vapor-liquid separation becomes easier. Because of this, discharge of vapor-phase refrigerant of air-bubble form which cannot be separated from the receiver 9 to the plurality of tubes for supercooling 21 is eliminated, and the supercooling portion 10 can be caused to operate effectively.

Accordingly, liquid-phase refrigerant distributed from the refrigerant outlet port 40 to the plurality of tubes for supercooling 21 exchanges heat with outside air via the corrugated fins 22 and is supercooled as it passes through this tubes for supercooling 21, becomes liquid-phase refrigerant having a supercooled degree, and flows into the outlet-side communicating chamber 30 of the first header 15.

Liquid-phase refrigerant which has flowed into the outlet-side communicating chamber 30 passes through the outlet piping 28 and sight glass 4, and flows into the expansion valve 5. Because supercooled liquid-phase refrigerant is supplied within the expansion valve 5, the degree of dryness of the refrigerant after pressure-reduction by the expansion valve 5 becomes small, and because of this, the refrigerant enthalpy differential between the inlet and outlet of the refrigerant evaporator 6 becomes large, and the cooling capacity of the automotive air-conditioning apparatus can be improved.

Moreover, according to the foregoing embodiment, a single rib 32*d* extending in the lengthwise direction is formed on the flat portion 32*a* of the tank plate 32, but in a case where the rib 32*d* is divided into a plurality in the length-wise direction or a width dimension of the flat portion 32*a* is established to be comparatively wide, it is also acceptable to form a plurality of parallel ribs 32*d*.

Additionally, the configuration of the rib 32*d* is not exclusively the configuration lacking an opening indicated in FIG. 2, but may be a configuration forming a punched-out opening in an indentation-tip side of the rib 32*d* indicated in FIG. 2.

In addition, according to the above-described embodiment, because the height of the second header 16 into which refrigerant flows after condensation is higher than the height of the receiver 9, the rib 32d extending in a length-wise direction is formed on the flat portion 32*a* of the tank plate 32 of the second header 16, but in a case where it is necessary to make the height of the receiver 9 higher than the height of the second header 16 because of various restrictions in condenser design, it is acceptable to form a rib similar to the foregoing rib 32*d* on the flat surface 33*a* of the tubular body 33 forming the receiver 9.

Furthermore, according to the foregoing embodiment the second header (the refrigerant-outlet side header of the condenser portion 8) 16 of the integral-receiver refrigerant condenser 3 was formed by the header plate 31 and tank plate 32, but the present invention can of course be embodied similarly even when of a format wherein the two parts 31 and 32 are formed with a tubular body and the flat portion 32*a* is formed on this tubular body.

Moreover, the foregoing embodiment described a case wherein the condenser portion 8 is disposed on an upper portion of the integral-receiver refrigerant condenser 3 and the supercooling portion 10 is disposed on the lower portion, but a structure wherein the supercooling portion 10 is abandoned, the entirety of the heat-exchanging portion (core portion 14) of the integral-receiver refrigerant condenser 3 is formed as the condenser portion 8, refrigerant condensed in this condenser portion 8 is caused to flow from the refrigerant inlet port 39 disposed below the refrigerant liquid level 9*a* of the vapor-liquid separation chamber 38 of the receiver 9 into liquid refrigerant within the chamber 38, and moreover the outlet piping 28 is disposed at a position below the foregoing refrigerant inlet port 39 and is joined by brazing to the tubular body 33 forming the vapor-liquid separation chamber 38, an inlet tip of this outlet piping 28 opens within the chamber 38 and made to be the refrigerant outlet port 40, and liquid refrigerant within the chamber 38 is cased to flow out from the outlet piping 28 directly to the outside and flow to the sight glass 4 side, is also acceptable.

Additionally, according to the foregoing embodiment, separators 35 and 36 are disposed one each within the first header 15 and second header 16 of the integral-receiver refrigerant condenser 3, but it is also acceptable to additionally installing respective separators in the upper-side communicating chambers 29 and 36 communicated with the plurality of tubes for condensing 19 forming the condenser portion 8 to further divide the rooms of these upper-side communicating chambers 29 and 36 and form intermediate communicating chambers, forming flow of refrigerant of an S-turn configuration within the condenser portion 8.

What is claimed is:

1. A refrigerant condenser with an integral receiver, comprising:

a core having a condenser portion to condense refrigerant flowing horizontally;

a header extending vertically at one end portion of said core, and connected to a downstream-side portion of said condenser portion, said header having a communication chamber therein communicating with one end of said condenser portion;

a receiver disposed to one side of said communicating chamber and having a vapor-liquid separation chamber for separating vapor-liquid of refrigerant;

a refrigerant introducing means for introducing refrigerant in said communicating chamber into said vapor-liquid separation chamber; and a refrigerant discharging means for discharging refrigerant located below said introducing means and in said vapor-liquid separation chamber to an outside of said separation chamber; wherein:

said header and said receiver are formed from first and second tubular bodies which extend vertically;

at least one of said first and second tubular bodies has a first flat portion and a curved portion on an outer-wall surface thereof, and the other has at least a second flat portion to join with said first flat portion;

said first flat portion has a rib depressed toward an inner side thereof.

2. A refrigerant condenser with an integral receiver, comprising:

a core having a condenser portion to condense refrigerant flowing horizontally;

a header extending vertically at one end portion of said core, and connected to a downstream-side portion of said condenser portion, said header having a communication chamber therein communicating with one end of said condenser portion;

a receiver disposed to one side of said communicating chamber and having a vapor-liquid separation chamber for separating vapor-liquid of refrigerant;

a refrigerant introducing means for introducing refrigerant in said communicating chamber into said vapor-liquid separation chamber; and a refrigerant discharging means for discharging refrigerant located below said introducing means and in said vapor-liquid separation chamber to an outside of said separation chamber, wherein said header and said receiver are formed from first and second tubular bodies which extend vertically;

one of said first and second tubular bodies has a first flat portion formed by pressing a part of outer periphery thereof and the other has a second flat portion to join with said first flat portion and an excess-pad absorbing portion to absorb excess pad material at a time of press.

3. A refrigerant condenser with an integral receiver according to claim 1, wherein said first tubular body having said flat portion and said curved portion is longer than said second tubular body having said second flat portion.

4. A refrigerant condenser with an integral receiver according to claim 2, wherein said first tubular body having said flat portion and said curved portion is longer than said second tubular body having said second flat portion.

5. A refrigerant condenser with an integral receiver, comprising:

a core having a condenser portion to condense refrigerant flowing horizontally at upper side and a supercooling portion to supercool said refrigerant condensed by said condenser portion by flowing horizontally at lower side;

a header extending vertically at one end portion of said core and communicating with a downstream end of said condenser portion at upper side and with an upstream end of said supercooling portion at lower side;

an upstream-side communicating chamber disposed within said header and communicating with a downstream end of said condenser portion;

a downstream-side communicating chamber disposed within said header below said upstream-side communicating chamber and communicating with an upstream end of said supercooling portion;

a receiver disposed to one side of said two communicating chambers and having a vapor-liquid separation chamber for separating vapor-liquid refrigerant;

a refrigerant introducing means for introducing refrigerant from said upstream-side communicating chamber into a liquid refrigerant storing portion located at a lower part of said vapor-liquid separation chamber;

a refrigerant discharging means disposed lower than said refrigerant introducing means for discharging refrigerant from said vapor-liquid separation chamber into said down- stream-side communicating chamber, wherein said header and said receiver are formed from first and second tubular bodies which extend vertically, said header is longer than said receiver in longitudinal length;

said first tubular body as said receiver has a first flat portion extending along an entire vertical length;

said second tubular body as said header has a second flat portion corresponding to said first flat portion at a part thereof along a vertical direction thereof;

said second flat portion has a rib depressed toward an inner side thereof; and said header and said receiver are integrally jointed with said first and second flat portion.

6. A refrigerant condenser with an integral receiver according to claim 5, wherein:

said header is formed from a header plate for communicating with said downstream end of said condenser portion and with said upstream end of said supercooling portion, and a tank plate to be integrally joined with said header plate so that said header plate and said tank plate forms said upstream-side communicating chamber and said downstream-side communicating chamber, said tank plate has one of said first and second flat portions on a part of its vertical portion.

7. A refrigerant condenser with an integral receiver according to claim 5, wherein:

said refrigerant introducing and discharging means are formed from passage holes penetrating said header and said receiver.

8. A refrigerant condenser with an integral receiver according to claim 7, wherein:

said rib is formed on said tank plate over substantially an entire surface of said second flat portion, except for an area around said passage hole.

9. A refrigerant condenser with an integral receiver according to claim 5, wherein:

said rib is formed simultaneously with said second flat portion by pressing formation.

10. A refrigerant condenser with an integral receiver according to claim 5, wherein:

said core, said header, and said receiver are joined integrally by brazing.

11. A refrigerant condenser with an integral receiver, comprising:

a core having a condenser portion to condense refrigerant flowing horizontally at an upper side and a supercooling portion to supercool said refrigerant condensed by said condenser portion by flowing horizontally at a lower side;

a header extending vertically at one end portion of said core and having an upstream-side communicating chamber disposed within said header and communicating with a downstream stream end of said condenser portion, and a downstream-side communicating chamber disposed within said header below said upstream-side communicating chamber and communicating with an upstream end of said supercooling portion;

a receiver disposed to one side of said two communicating chambers and having a vapor-liquid separation chamber for separating vapor-liquid refrigerant;

refrigerant introducing means for introducing refrigerant from said upstream-side communicating chamber into a liquid refrigerant storing portion located at a lower part of said vapor-liquid separation chamber; and refrigerant discharging means disposed lower than said refrigerant introducing means for discharging refrigerant from said vapor-liquid separation chamber into said down-stream-side communicating chamber, wherein said header is formed from a header plate and communicating with said downstream end of said condenser portion and said upstream end of said supercooling portion, and a tank plate communicating with said receiver, said refrigerant introducing and discharging means are formed from passage holes penetrating said header and said receiver, said header has a partition to form said refrigerant introducing and discharging means by partitioning said through hold, said taken plate has a flat portion including said through hole, said flat portion has a rib adjacent to said passage hole, and said taken plate has an arc portion adjacent to said passage hole to form an end of said flat portion, so that an excess-pad caused by forming said passage hole in said tank plate adjacent to said passage hole is absorbed by said rib and said arc-portion in producing said taken plate.

* * * * *